US011141838B2

(12) United States Patent
Wu

(10) Patent No.: US 11,141,838 B2
(45) Date of Patent: Oct. 12, 2021

(54) PIPE WRENCH

(71) Applicant: PROXENE TOOLS CO., LTD., Taichung (TW)

(72) Inventor: Arthur Wu, Taichung (TW)

(73) Assignee: PROXENE TOOLS CO., LTD., Taichung (TW)

( * ) Notice: Subject to any disclaimer, the term of this patent is extended or adjusted under 35 U.S.C. 154(b) by 302 days.

(21) Appl. No.: 16/267,818

(22) Filed: Feb. 5, 2019

(65) Prior Publication Data

US 2020/0246942 A1 Aug. 6, 2020

(51) Int. Cl.
*B25B 7/10* (2006.01)

(52) U.S. Cl.
CPC ..... *B25B 7/10* (2013.01)

(58) Field of Classification Search
CPC .... B25B 7/00; B25B 7/02; B25B 7/04; B25B 7/10; B25B 7/12; B25B 7/123; B25B 7/14; B25B 7/18; B25B 7/06; B25B 7/08
See application file for complete search history.

(56) References Cited

U.S. PATENT DOCUMENTS 2,557,296 A 6/1951 Kress
4,269,089 A 5/1981 Hastings
6,892,609 B2 * 5/2005 Kuo ..... B25B 7/10 81/409.5
7,182,004 B1 * 2/2007 Wang ..... B25B 7/10 81/409.5
7,614,324 B2 * 11/2009 Bocquet ..... B25B 7/10 81/411
2010/0064861 A1 * 3/2010 Herrmann ..... B25B 7/10 81/409
2017/0066112 A1 * 3/2017 Herrmann ..... B25B 7/10
2020/0061778 A1 * 2/2020 Doyle ..... B25B 7/14

FOREIGN PATENT DOCUMENTS

CN 204843895 U 12/2015
CN 106103000 A 11/2016

* cited by examiner

*Primary Examiner* — Robert J Scruggs
(74) *Attorney, Agent, or Firm* — Muncy, Geissler, Olds & Lowe, P.C.

(57) ABSTRACT

A pipe wrench is provided, including a first lever member, a pivot and a second lever member. The first lever member includes a first grip portion, a first clamping portion and a body portion, and the body portion has at least one guide toothed groove. The pivot is slidably disposed within the at least one guide toothed groove, and the pivot is slidable along an axial direction to be on a locked position or a released position. The second lever member include a second grip portion, a pivot hole and a second clamping portion, and the pivot is disposed through and pivoted to the pivot hole.

14 Claims, 13 Drawing Sheets

PIPE WRENCH

BACKGROUND OF THE INVENTION

Field of the Invention

The present invention relates to a pipe wrench.

Description of the Prior Art

Generally, a pipe wrench includes a first lever member and a second lever member pivoted to each other, the first lever member has a slide slot, within the slide slot is a pivot, the second lever member is pivoted to the pivot to make the second lever member slide and swing relative to the first lever member. Normally, a first toothed portion of the first lever member is meshed with a second toothed portion of the pivot, through pressing the pivot to make the first toothed portion detach from the second toothed portion, the pivot and the second lever member can slide relative to the first lever member so as to adjust a relative distance between a first clamping portion of the first lever member which is fixed and a second clamping portion of the second lever member which is movable, and after adjustment, the second lever member is swingable to make the second clamping portion which is movable swing toward the first clamping portion which is fixed to clamp a rectangular or hexagonal joint of a pipe. Such pipe wrench is disclosed in CN204843895. In addition, to improve the seal tightness between the first and second lever members and the whole pipe wrench, an elastic mechanism is provided at a bottom of the pivot and elastically biases the pivot to make sure that the second toothed portion of the pivot and the first toothed portion of the jaw are meshed with each other, as disclosed in CN106103000, U.S. Pat. Nos. 2,557,296, 4,269,089 and US2017/0066112.

However, the conventional pipe wrenches still have some disadvantages. In normal state, the first toothed portion and the second toothed portion are meshed with each other to lock each other in position, when the pivot is pressed along an axial direction of the pivot, the first and second toothed portions can easily be detached from each other, and the pivot and the second lever member can slide relative to the first lever member; however, when the pivot is released, as shown in FIG. 14, the first toothed portion B1 and the second toothed portion B2 move relatively horizontally, and due to tooth space and tooth type, an addendum of the first toothed portion and a dedendum of the second toothed portion cannot smoothly engaged with each other along the axial direction of the pivot B3, and the second toothed portion of the pivot cannot be smoothly meshed with the first toothed portion to position the pivot on a locked position. Therefore, the pivot and the second lever member still slide relative to the first lever member, a user needs to manually adjust relative positions of the pivot and the second lever member so that the pivot and the first lever member can be accurately meshed and positioned.

The present invention has arisen to mitigate and/or obviate the afore-described disadvantages.

SUMMARY OF THE INVENTION

The major object of the present invention is to provide a pipe wrench, when a pivot is released, a guide toothed groove of a first lever member and a position-restricting toothed portion of the pivot can be easily locked, so the pivot can freely and quickly aligned to make the guide toothed groove and the position-restricting toothed portion easily meshed with each other, and the pivot can be quickly switched between a locked position or a released position to effectively elevate operation efficiency.

To achieve the above and other objects, a pipe wrench is provided, including a first lever member, a pivot and a second lever member. The first lever member includes a first grip portion, a first clamping portion and a body portion which is connected to and between the first grip portion and the first clamping portion, and the body portion has at least one guide toothed groove. The pivot is positionably and slidably disposed within the at least one guide toothed groove, the pivot is slidable along an axial direction to be on a locked position or a released position, the pivot has at least one position-restricting toothed portion and at least one elastic mechanism, and each of the at least one elastic mechanism corresponds to one of the at least one position-restricting toothed portion in the axial direction. The second lever member includes a second grip portion, a pivot hole and a second clamping portion, the pivot is disposed through and pivoted to the pivot hole, and through the second lever member sliding or swinging relative to the first lever member, the first clamping portion is slidable relative to the second clamping portion. When the pivot is on the locked position (when the pivot is not manually operate and not pressed), the position-restricting toothed portion and the guide toothed groove are meshed with each other, and the elastic mechanism is non-engaged with the guide toothed groove; when the pivot moves to the released position (when the pivot is manually pressed), the position-restricting toothed portion and the guide toothed groove are detached from each other, and the elastic mechanism is releasably engaged with the guide toothed groove.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
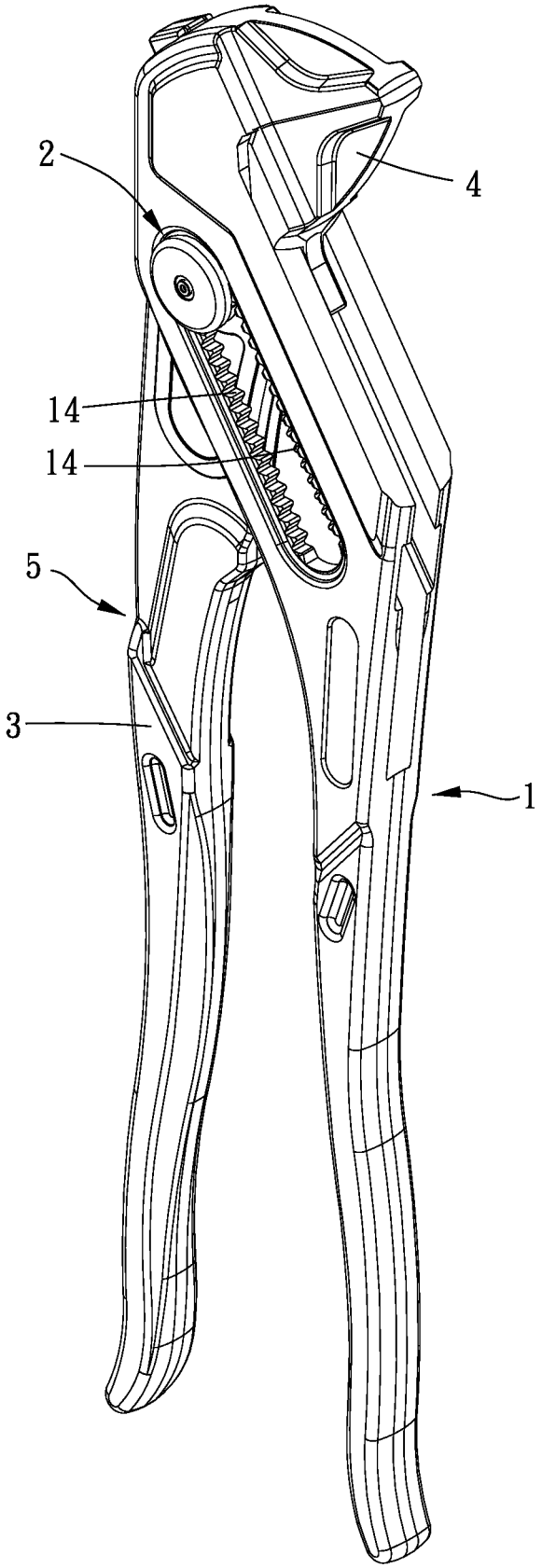
FIG. 1 is a stereogram of a preferred embodiment of the present invention.
Figure 2:
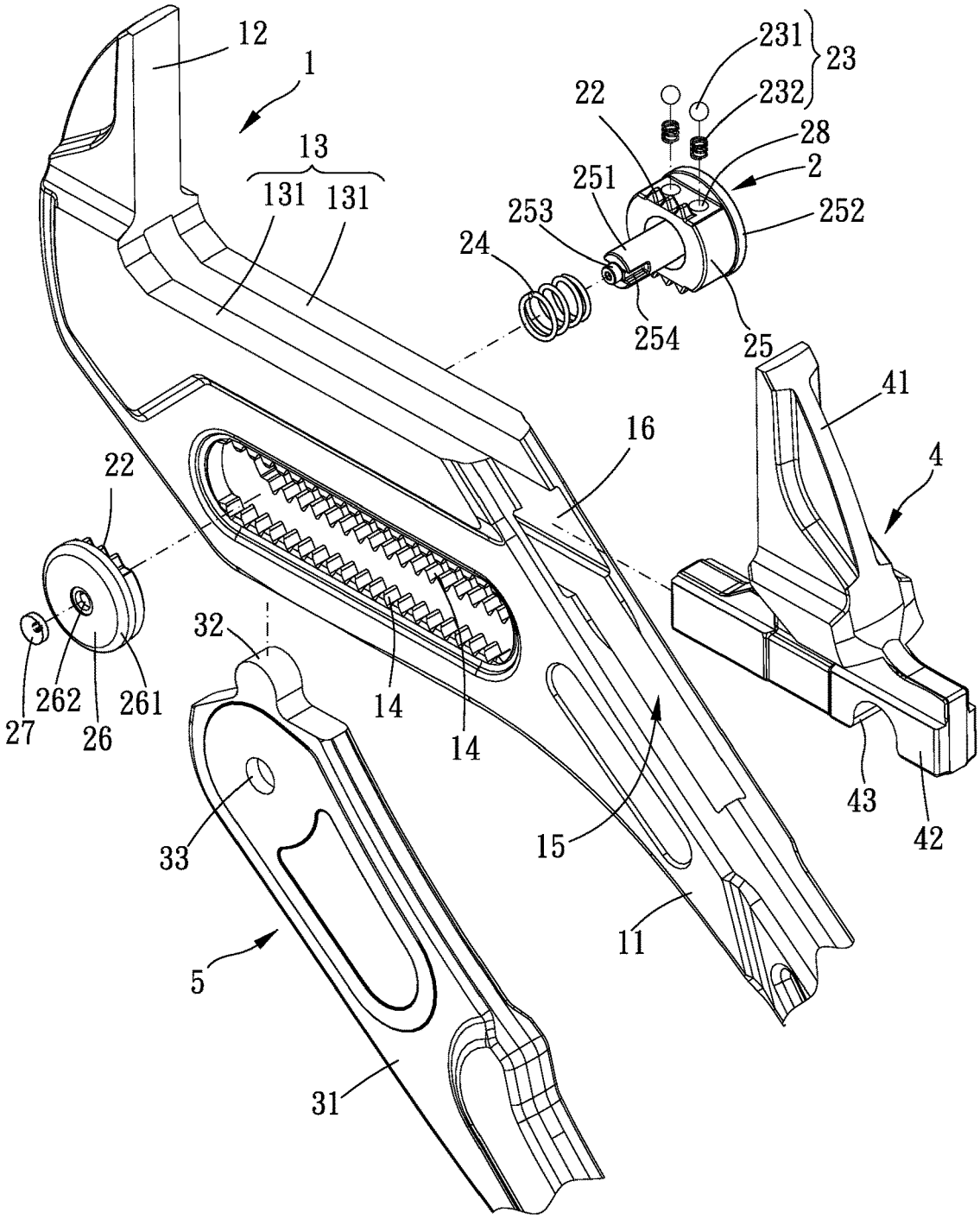
FIG. 2 is a breakdown view of the preferred embodiment of the present invention.
Figure 3:
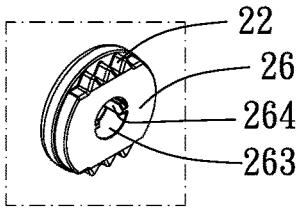
FIG. 3 is a partially breakdown view of preferred embodiment of the present invention.
Figure 4:
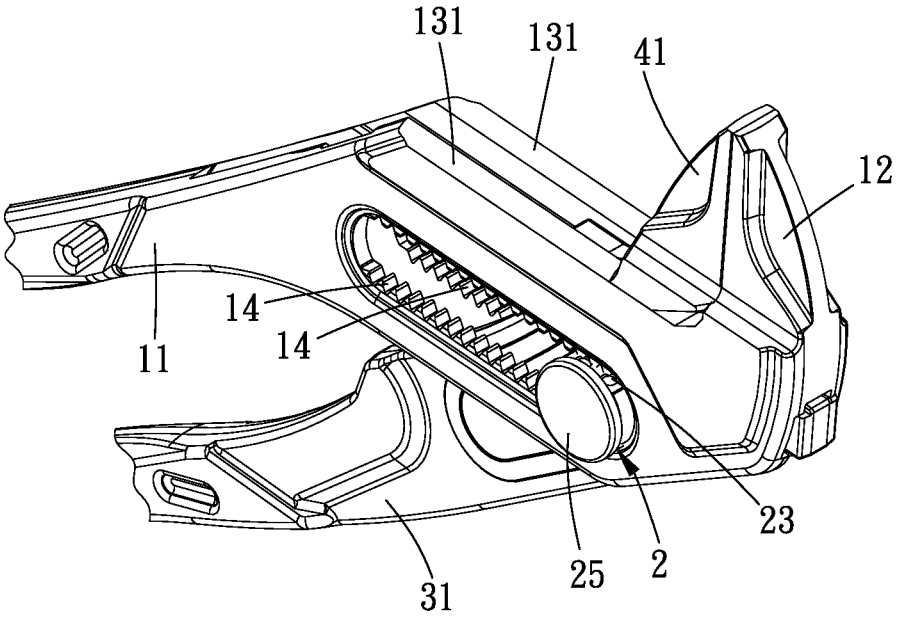
FIG. 4 is another stereogram of the preferred embodiment of the present invention.

The present invention will be clearer from the following description when viewed together with the accompanying drawings, which show, for purpose of illustrations only, the preferred embodiment in accordance with the present invention.

Please refer to FIGS. 1 to 11 for a preferred embodiment of the present invention, a pipe wrench includes a first lever member 1, a pivot 2 and a second lever member 5.

The first lever member 1 includes a first grip portion 11, a first clamping portion 12 and a body portion 13 which is connected to and between the first grip portion 11 and the first clamping portion 12, and the body portion 13 has at least one guide toothed groove 14.

The pivot 2 is positionably and slidably disposed within the at least one guide toothed groove 14, the pivot 2 is slidable along an axial direction to be on a locked position or a released position, the pivot 2 has at least one position-restricting toothed portion 22 and at least one elastic mechanism 23, and each of the at least one elastic mechanism 23 corresponds to one of the at least one position-restricting toothed portion 22 along the axial direction.

The second lever member 5 includes a second grip portion 31, a pivot hole 33 and a second clamping portion 41, the pivot 2 is disposed through and pivoted to the pivot hole 33, and through the second lever member 5 sliding or swinging relative to the first lever member 1, the first clamping portion 12 is slidable relative to the second clamping portion 41.

Figure 6:
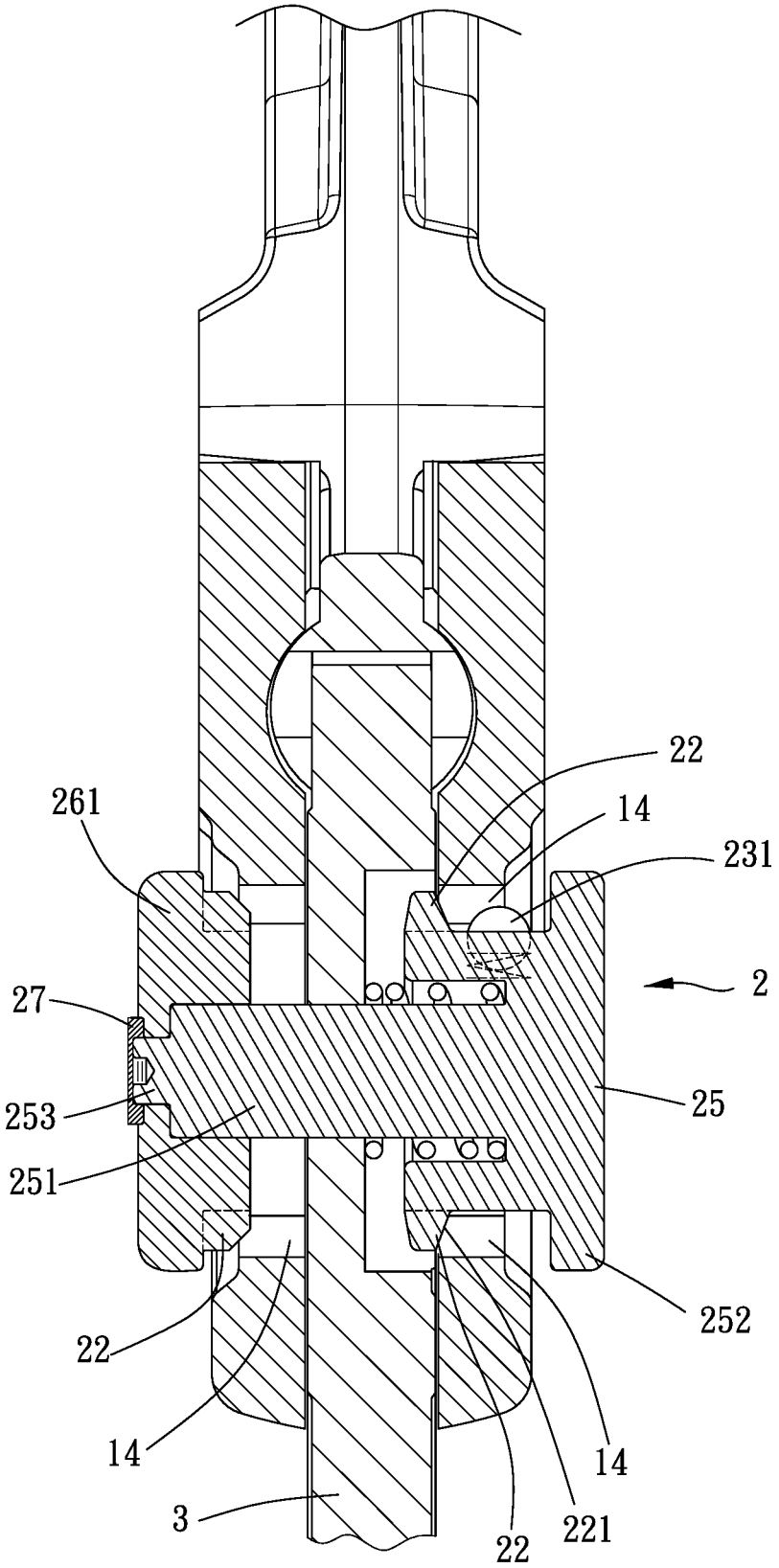
FIG. 6 is a cross-sectional operation view of the preferred embodiment of the present invention when the pivot moves to a half-released position.
Figure 7:
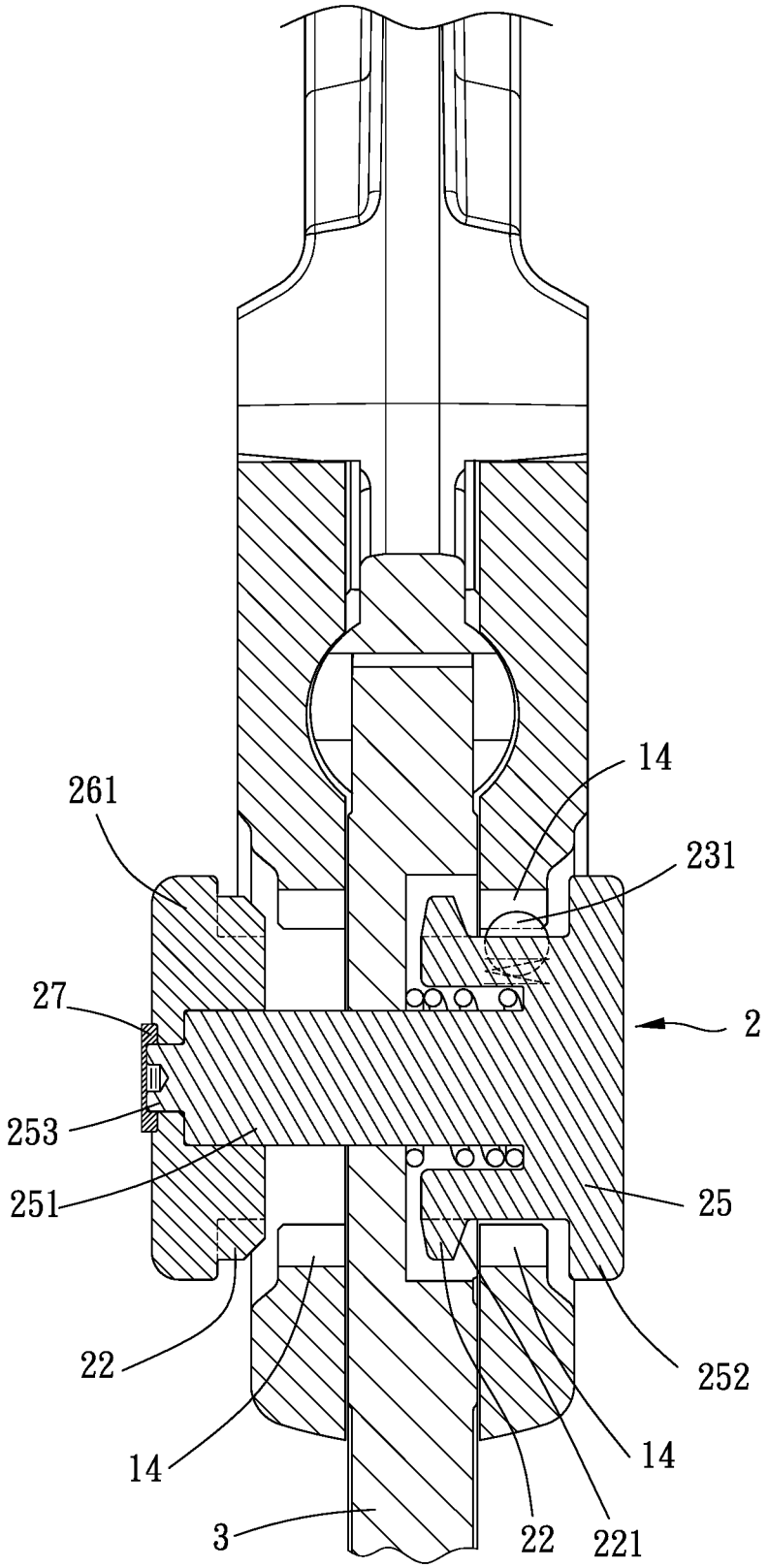
FIG. 7 is a cross-sectional operation view of the preferred embodiment of the present invention when the pivot moves to a released position completely.
Figure 8:
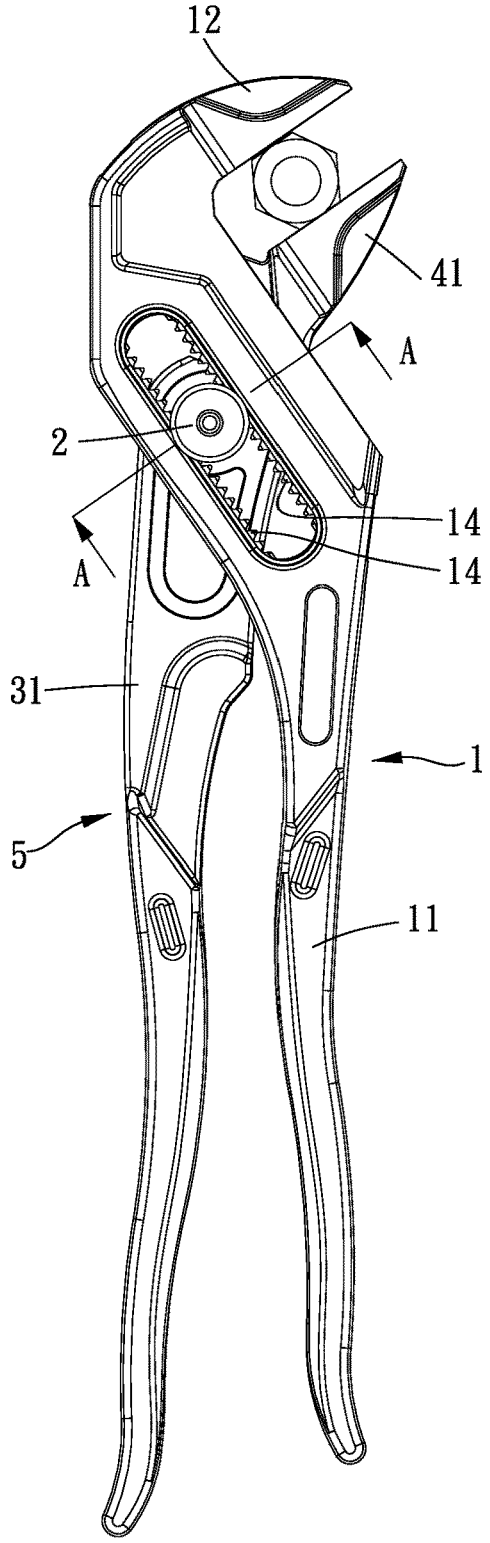
FIGS. 8 and 9 are drawings showing an operation of the preferred embodiment of the present invention.
Figure 9:
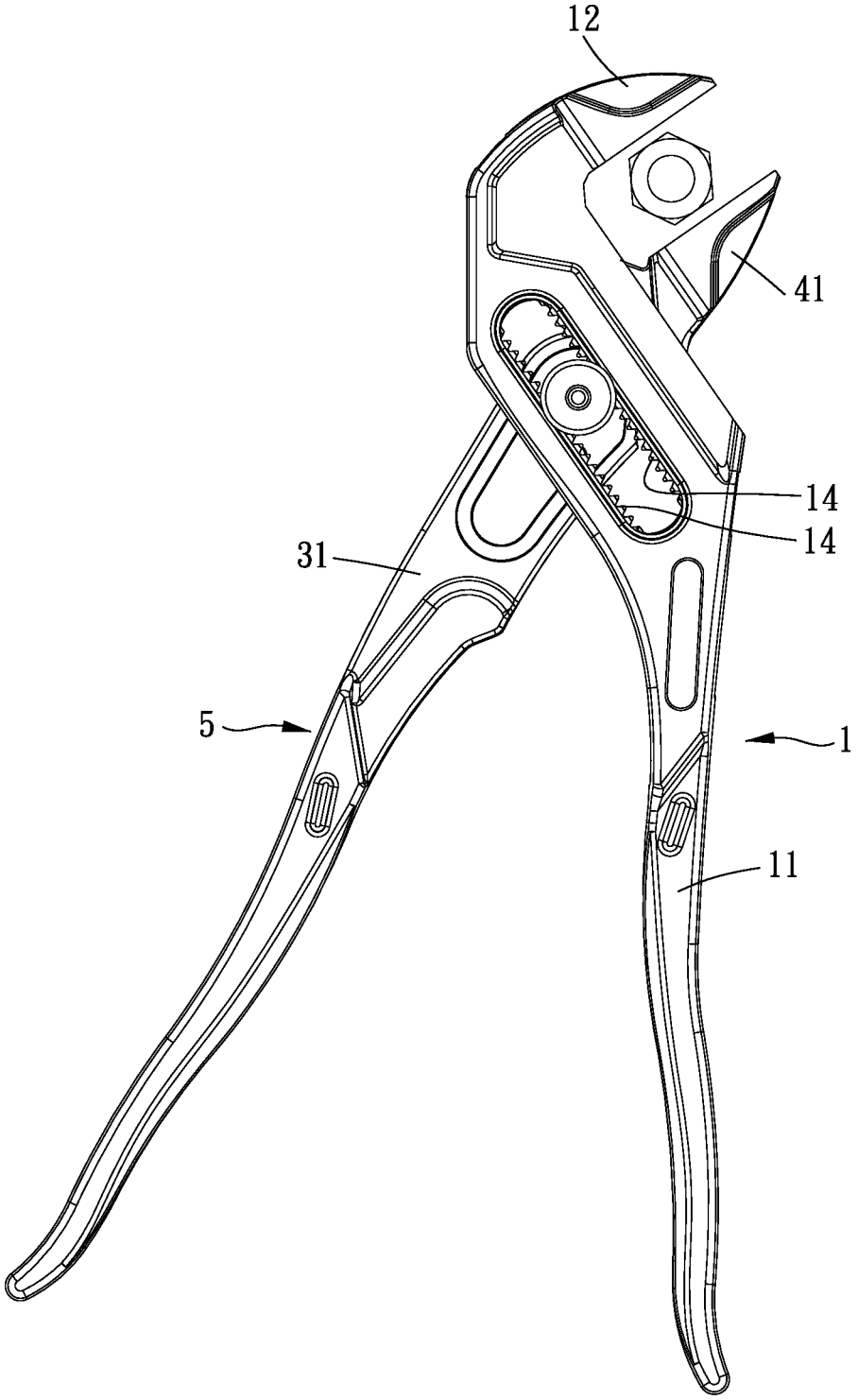
Figure 10:
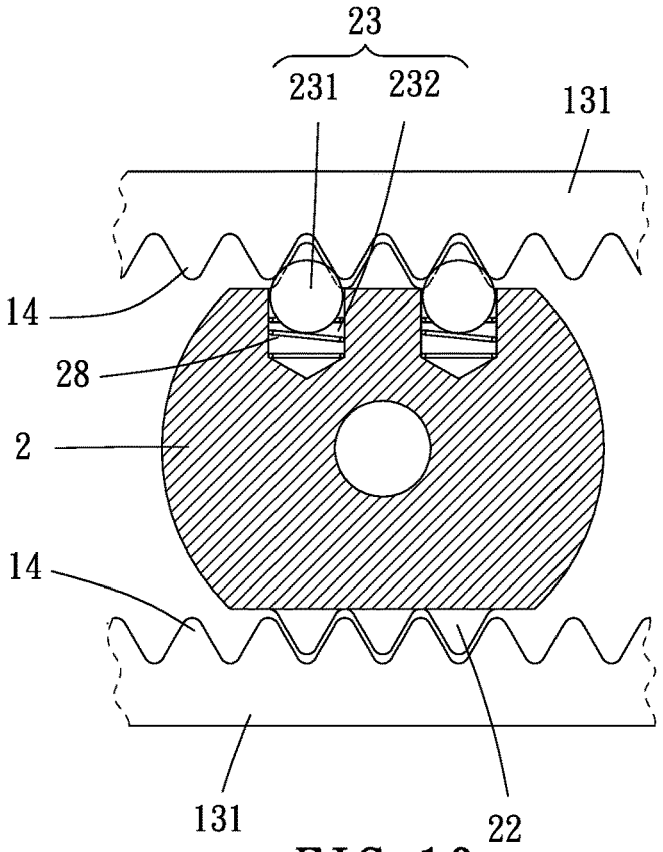
FIGS. 10 and 11 are cross-sectional operation views, taken along line A-A of FIG. 8.
Figure 11:
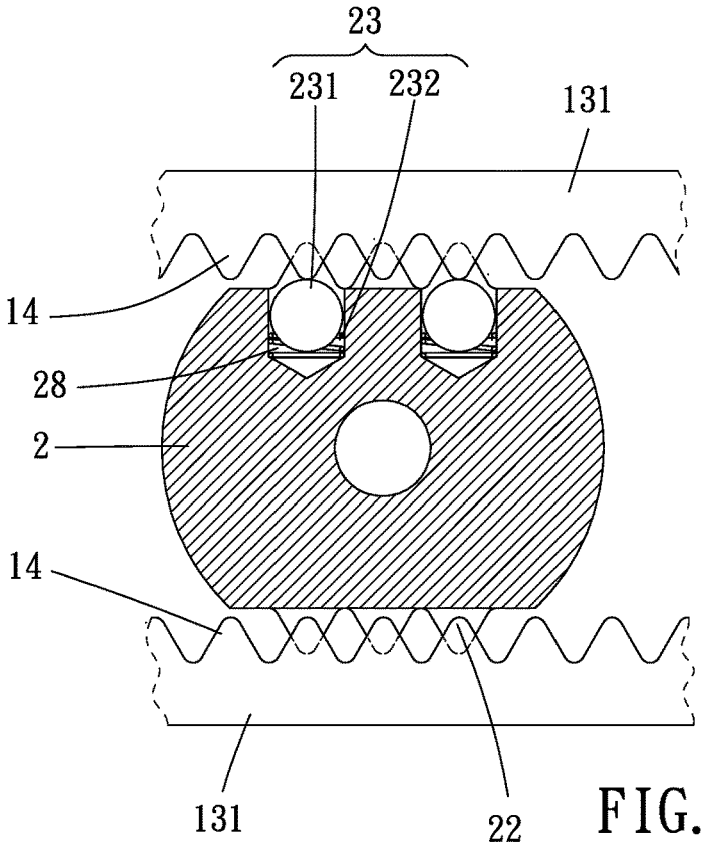

When the pivot 2 is on the locked position, the position-restricting toothed portion 22 and the guide toothed groove 14 are meshed with each other, and the elastic mechanism 23 is non-engaged with the guide toothed groove 14; when the pivot 2 moves to the released position, the position-restricting toothed portion 22 and the guide toothed groove 14 are detached from each other, and the elastic mechanism 23 is releasably engaged with the guide toothed groove 14 (as shown in FIGS. 6 and 7). Specifically, when the pivot 2 starts to be pressed for a small distance, the elastic mechanism 23 enters the gap between the guide toothed groove 14; when the pivot 2 is pressed to be on the released position completely, the position-restricting toothed portion 22 and the guide toothed groove 14 are detached from each other, the pivot 2 can be moved relatively horizontally along the guide toothed groove 14 to adjust an opening of the pipe wrench, at this moment, the elastic mechanism 23 is repeatedly pressed and reposition and can be engaged between the gap of the guide toothed groove 14 any time; when the pivot 2 is released, being guided by the elastic mechanism 23, the position-restricting toothed portion 22 and the guide toothed groove 14 can be easily meshed with each other and repositioned and locked on any position, at this moment, the pivot 2 is slidable to be on any position of the guide toothed groove 14, the bouncing 23 is freely compressed by a part of the guide toothed groove 14 near an addendum, the elastic mechanism 23 also freely repositions from near a part of the guide toothed groove 14 near a dedendum directly into a space between two gaps of the guide toothed groove 14 to alternate repeatedly. Through the elastic mechanism tripping from the guide toothed groove 14, the pivot 2 and the second lever member 5 can slide along an extension direction of the guide toothed groove 14 (as shown in FIGS. 10 and 11) to quickly adjust relative positions of the second lever member 5 and the first lever member 1. Because the elastic mechanism 23 is releasably engaged between the gap of the guide toothed groove 14, when the pivot 2 is released and back to a locked state, most parts of the elastic mechanism 23 automatically guide the elastic mechanism 23 to be between two gaps of the guide toothed groove 14 except for a spot of the elastic mechanism 23 which is vertical to the addendum of the guide toothed groove 14, each of the elastic mechanism 23 and one of teeth of the position-restricting toothed portion 22 have a common central line widthwise across the guide toothed groove 14, and the position-restricting toothed portion 22 and the guide toothed groove 14 can easily aligned and meshed with each other and locked. Therefore, when the pivot 2 is moving to the locked position, the position-restricting toothed portion 22 and the guide toothed groove 14 can be quickly and easily aligned and meshed with each other, so that the disadvantage of the prior art that engagements of addendum flanks of the position-restricting toothed portion 22 and the guide toothed groove 14 along the axial direction makes the pivot 2 incapable of being positioned to the locked position can be prevented. With the present invention, the position-restricting toothed portion 22 and the guide toothed groove 14 can be smoothly and easily meshed with each other, and the pivot 2 can be quickly switched between the locked position and the released position to effectively elevate the operation efficiency.

Specifically, in this embodiment, the body portion 13 includes two side plates 131 which correspond to each other and respectively have one of the at least one guide toothed groove 14, the two side plates 131 have a receiving groove 15 therebetween, one of two sides of each of the two side plates 131 has a slide slot 16, the two slide slots 16 and the two guide toothed grooves 14 are parallel to each other and non-overlapping, the second lever member 5 includes a driving grip 3 and a clamping member 4, the driving grip 3 and the first lever member 1 are pivoted to the pivot 2, one of two ends of the driving grip 3 has the second grip portion 31, the other of the two ends of the driving grip 3 has a cam 32, the driving grip 3 has the pivot hole 33, the clamping member 4 includes the second clamping member 41 and a slidable block 42 which are connected to each other, the slidable block 42 is slidable within the two slide slots 16, the clamping member 4 has a recessed portion 43, the cam 32 is abuttably inserted within the recessed portion 43, and through the driving grip 3 sliding or swinging relative to the first lever member 1, the cam 32 is capable of controlling the clamping member 4 to slide relative to the first lever member 1 so that the first and second clamping portions 12, 41 can easily clamp a tube member. In this embodiment, the slidable block 42 of the clamping member 4 is rectangular columnar, the two slide slots 16 are n-shaped slots to be complementary to the slidable block 42, the recessed portion 43 is recessed on the slidable block 42, and in other embodiments, the slidable block 42 and the two slide slots 16 can be in other shapes (for example, cylindrical and arc groove). In this embodiment, the pivot 2 further has a first elastic member 24, the first elastic member 24 biases between the driving grip 3 and the pivot 2 to move the pivot 2 normally toward the locked position so that when the pivot 2 is not influenced by a force, the pivot 2 automatically aligns to the locked position.

In addition, each of at least one of the elastic mechanism 23 includes an engaging member 231 and a second elastic member 232, the pivot 2 has at least one receiving hole 28, the engaging member 231 and the second elastic member 232 of each of the at least one elastic mechanism 23 are received within one of the at least receiving hole 28, and the second elastic member 232 normally biases the engaging member 231 toward an outside of the receiving hole 28. In this embodiment, the engaging member 231 is a ball which can easily trip from the guide toothed groove 14, a hole diameter of the receiving hole 28 is slightly greater than a diametric dimension of the ball, and a surface of the receiving hole 28 is riveted so as to prevent the ball from falling off.

Preferably, the pivot 2 includes a first connecting member 25 and a second connecting member 26, the first connecting member 25 has a rod member 251, the rob member 251 is disposed through the pivot hole 33 of the second lever member 5, the second connecting member 26 is abuttably connected to one of two ends of the rod member 251, and a first elastic member 24 is sleeved to the rod member 251. It is to be noted that in this embodiment, the first and second connecting members 25, 26 respectively have a plurality of the position-restricting toothed portion 22, and in this embodiment, numbers of the at least one elastic mechanism 23 and the at least one receiving hole 28 are both two, the two elastic mechanisms 23 and the two receiving holes 28 are disposed on the first connecting member 23, and in other embodiments, the position-restricting toothed portion 22 and the receiving holes 28 may be arranged in other ways, not limited hereto.

In addition, one of two ends of the first connecting member 25 and one of two ends of the second connecting member 26 which are remote from each other respectively have a first head portion 252 and a second head portion 261 projecting radially, and diametric dimensions of the first head portion 252 and the second head portion 261 are each greater than a width of the guide toothed groove 14 to prevent the first and second connecting members 25, 26 from falling off from the two side plates 131.

Preferably, one of two ends of the rod member 251 which is remote from the first head portion 252 further has a protrusive portion 253 which has a smaller diameter, the protrusive portion 253 is inserted into a through hole 262 of the second connecting member 26, a fixing member 27 is screwed with the protrusive portion 253 from a side of the through hole 262 which is remote from the first connecting member 25, a greatest diametric dimension of the fixing member 27 is greater than a diametric dimension of the through hole 262 so that the first and second connecting members 25, 26 can easily fixed with each other, two radial sides of the rod member 251 each have an engaging recess 254, a side of the second connecting member 26 facing the first connecting member 25 has a hole 263, the rod member 251 is inserted into the hole 263, the hole 263 communicates with the through hole 262, an internal circumferential wall of the hole 263 has two engaging protrusions 264, and each of the two engaging protrusions 264 is engaged with one of the two engaging recesses 254 to prevent the first and second connecting members 25, 26 from rotating relative to each other.

It is to be noted that in this embodiment, a respective side of each of the at least one position-restricting toothed portion in the axial direction has a slant face section 221, and when the pivot 2 moves to the released position, the slant face section 221 of the position-restricting toothed portion 22 faces the guide toothed groove 24 to which the slant face section 221 corresponds. Specifically, when the pivot 2 is moving from the released position to the locked position, if the position-restricting toothed portion 22 does not align to the guide toothed groove 14 and cannot be meshed with the guide toothed groove 14, the slant face section 221 of each of the at least one position-restricting toothed portion 22 faces one of the at least one guide tooted groove 14 to which the slant face section 221 corresponds (as shown in FIGS. 5 to 7), the slant face section 221 slides into the guide toothed groove 4 first so that the position-restricting toothed portion 22 can be easily meshed with the guide toothed groove 14, and the pivot 2 can easily align to the locked position; therefore, the two slant face sections 221 of the two position-restricting toothed portions 22 allow the pivot 2 to move from the released portion to the locked position more easily.

Figure 5:
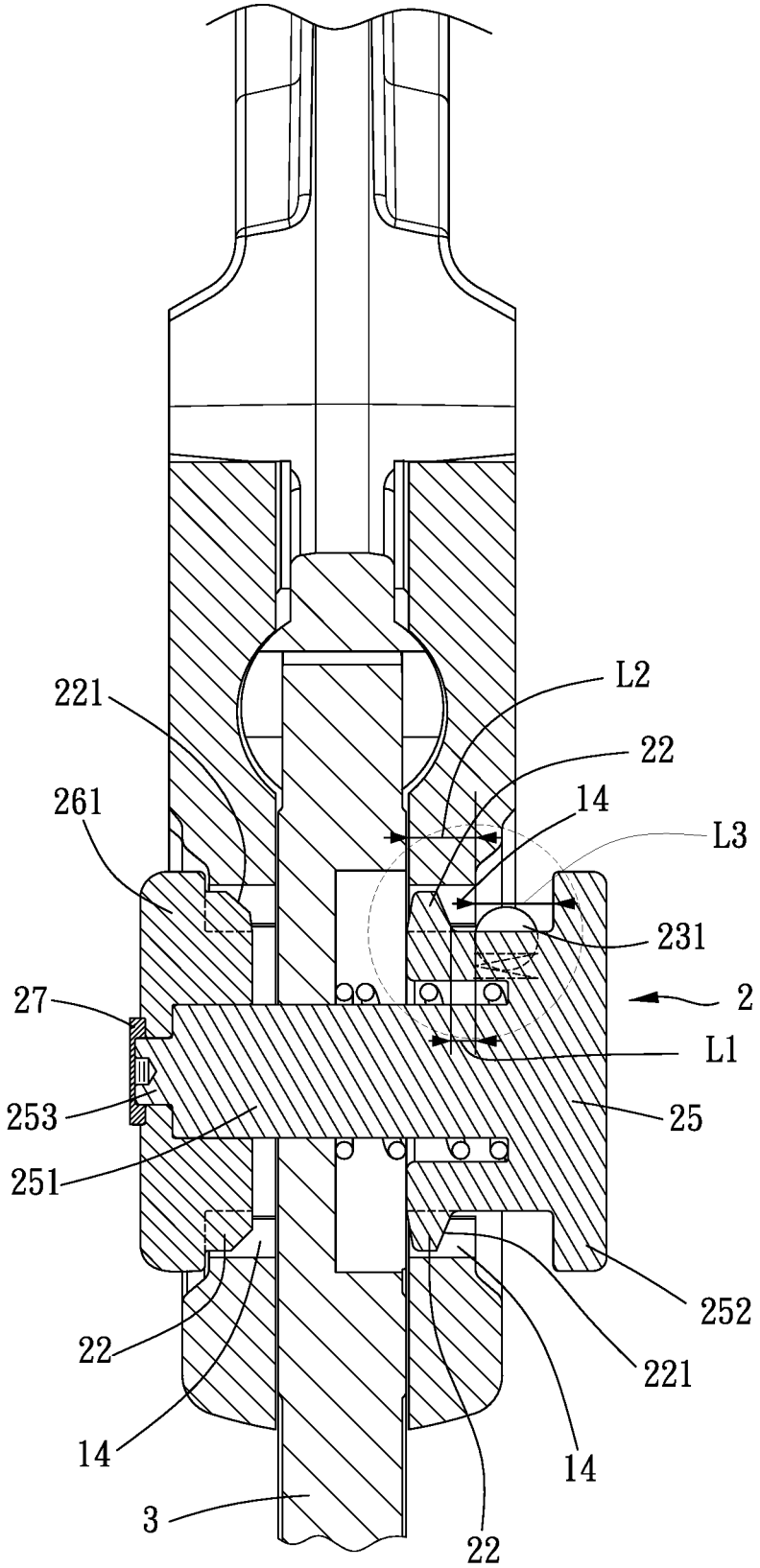
FIG. 5 is a cross-sectional view of the preferred embodiment of the present invention when a pivot is on a locked position.
Figure 5A:
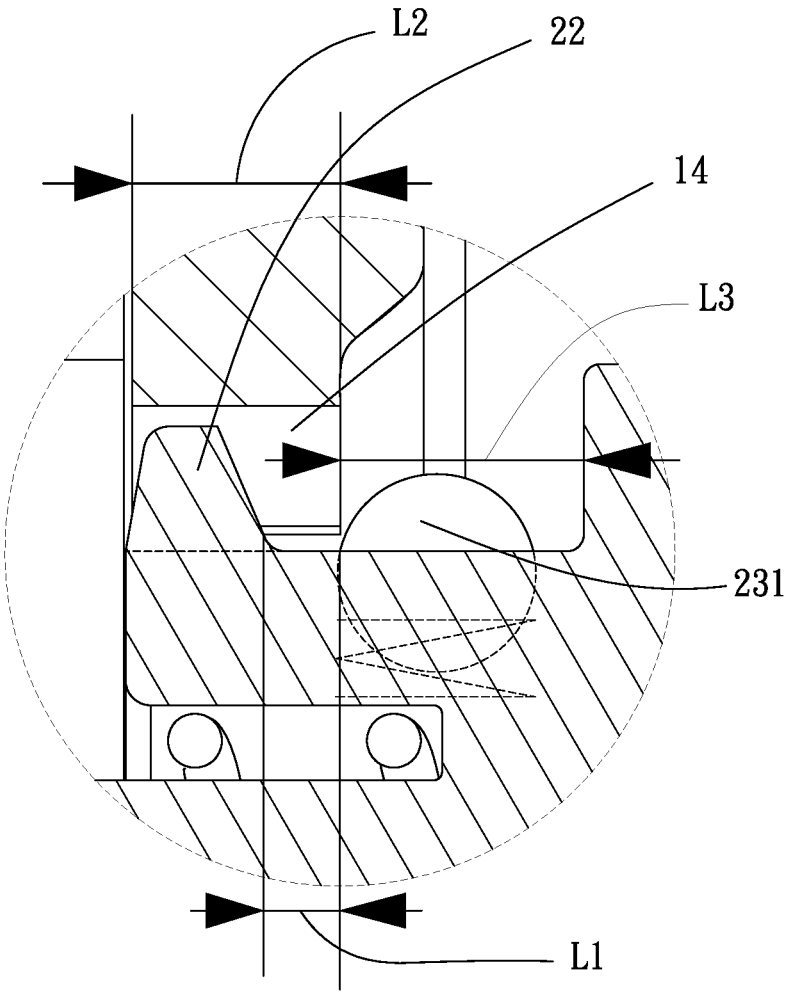
FIG. 5A is a partially-enlarged view of FIG. 5.

Preferably, in this embodiment, along the axial direction a shortest distance between the position-restricting toothed portion 22 and the elastic mechanism 23 to which the position-restricting toothed portion 22 corresponds defines a first length L1, a thickness of the guide toothed groove 14 along the axial direction defines a second length L2, and the second length L2 is greater than the first length L1 (as shown in FIG. 5), so when the position-restricting toothed portion 22 has not tripped from the guide toothed groove 14, the elastic mechanism 23 enters the guide toothed groove 14, and the pivot 2 can be switched between the locked position and the released position more easily. In addition, in this embodiment, along the axial direction a width of a bottom edge of the first connecting member 25 and an outer edge of the guide toothed groove 14 which the first connecting member 25 faces defines a third length L3, and the third length L3 is greater than the second length L2 (as shown in FIGS. 5 and 5A) to make sure that the pivot 2 can move to the released position completely (as shown in FIG. 7).

Figure 12:
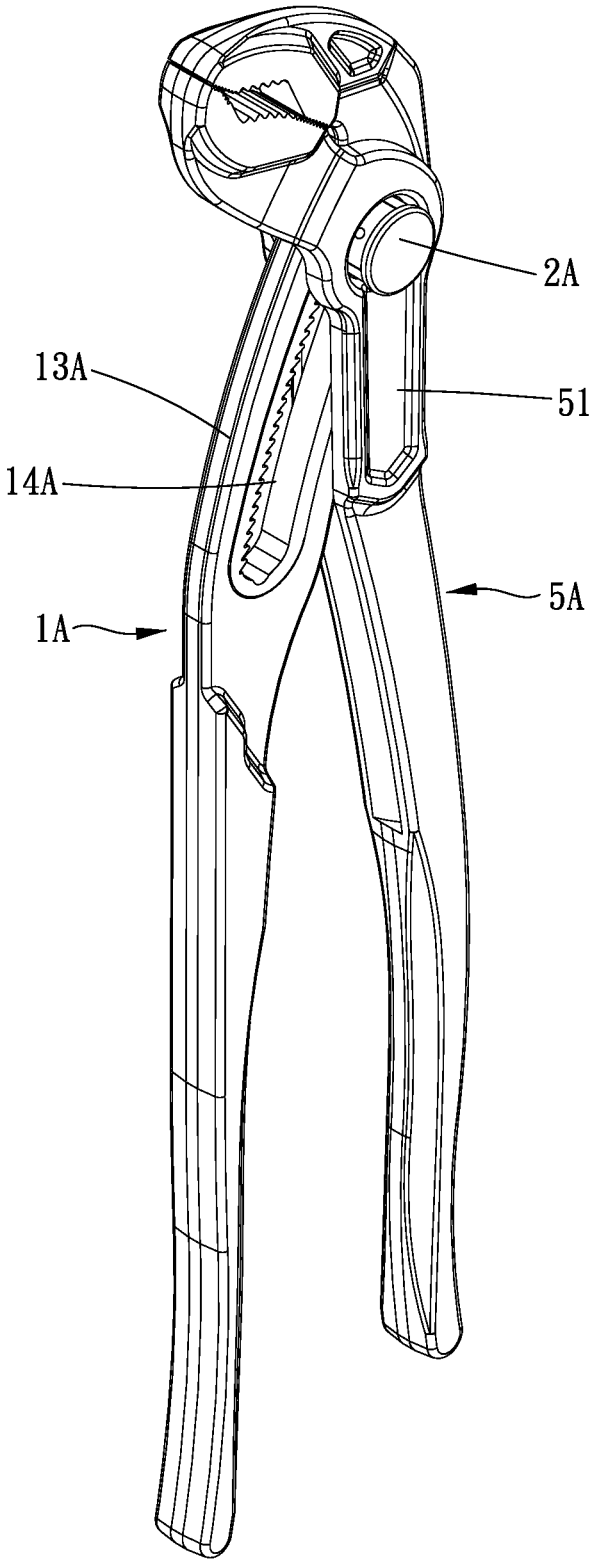
FIG. 12 is a stereogram of another preferred embodiment of the present invention.
Figure 13:
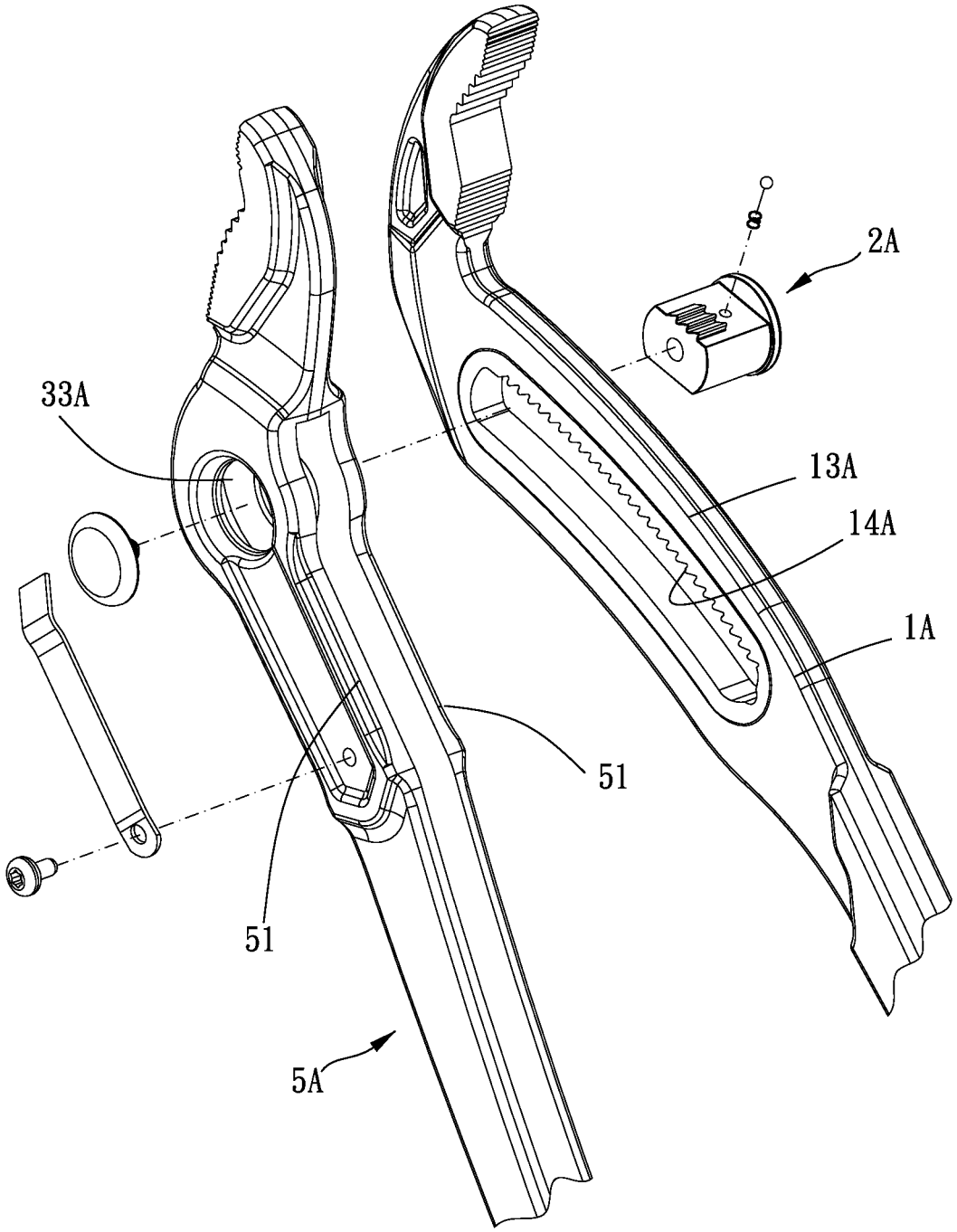
FIG. 13 is a breakdown view of another preferred embodiment of the present invention.
Figure 14:
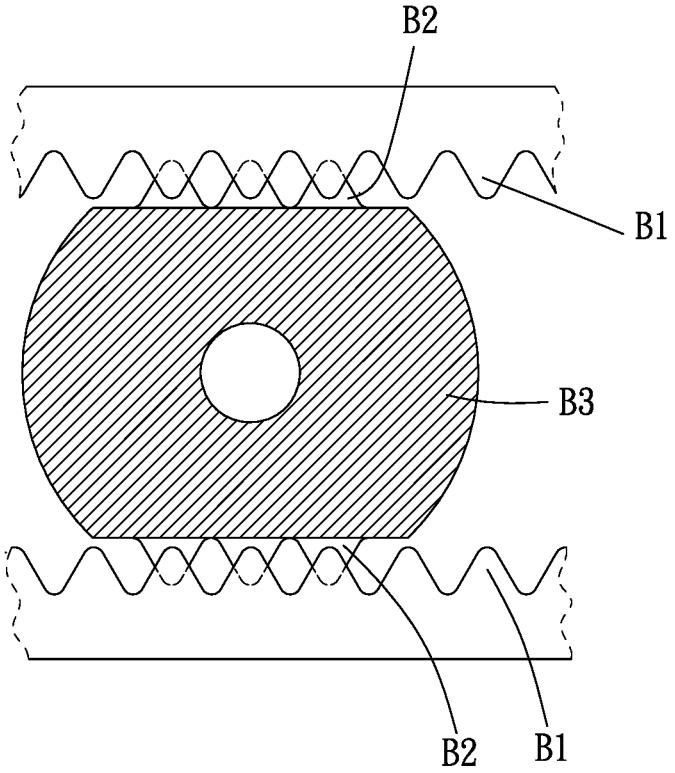
FIG. 14 PRIOR ART
FIG. 14 is a cross-sectional operation view of the pivot of a known pipe wrench.

Compared with the embodiment above, in another embodiment of the present invention of FIGS. 12 and 13, the body portion 13A of the first lever member 1A does not have the two side plates 131 but has one of the at least one guide toothed groove 14A, the second lever member 5A has two partitions 51, the pivot hole 33A is disposed through the two partitions 51, the first lever member 1A is disposed between the two partitions 51, and the pivot 2A is disposed through and pivoted to the pivot hole 33A of the two partitions 51. Thereby, with a simpler structure of this embodiment, the relative positions of the second and first lever members 5A, 1A can be quickly adjusted, and the pivot 2A still can be switched between the locked position and the released position to effectively elevate the operation efficiency.

Given the above, in the pipe wrench of the present invention, when the pivot aligns to the locked position, the elastic mechanism is releasably engaged with the guide toothed groove, the pivot can be smoothly aligned, and the position-restricting toothed portion and the guide toothed groove can be quickly and easily aligned to and meshed with each other; therefore, the position-restricting toothed portion and the guide toothed groove can be prevented from being engaged with each other along the axial direction and from making the pivot incapable of aligning to the locked position. In the present invention, the position-restricting toothed portion and the guide toothed groove can be easily meshed with each other, and the pivot can be quickly switched between the locked position and the released position to effectively elevate the operation efficiency.

While we have shown and described various embodiments in accordance with the present invention, it should be clear to those skilled in the art that further embodiments may be made without departing from the scope of the present invention.

What is claimed is:

1. A pipe wrench, including:

a first lever member, including a first grip portion, a first clamping portion and a body portion which is connected to and between the first grip portion and the first clamping portion, the body portion having at least one guide toothed groove;

a pivot, positionably and slidably disposed within the at least one guide toothed groove, the pivot being slidable along an axial direction to be on a locked position or a released position, the pivot having at least one position-restricting toothed portion on a side radially opposite to and facing the at least one guide toothed groove and at least one elastic mechanism on the side radially opposite to and facing the at least one guide toothed groove, each of the at least one elastic mechanism being axially aligned with one of the at least one position-restricting toothed portion in the axial direction;

a second lever member, including a second grip portion, a pivot hole and a second clamping portion, the pivot being disposed through and pivoted to the pivot hole, through the second lever member sliding or swinging relative to the first lever member, the first clamping portion being slidable relative to the second clamping portion;

wherein when the pivot is on the locked position, the position-restricting toothed portion and the guide toothed groove are meshed with each other, and the elastic mechanism is located out of the guide toothed groove; when the pivot moves to the released position, the position-restricting toothed portion and the guide toothed groove are detached from each other, and the elastic mechanism is radially overlapped with and releasably engaged within the guide toothed groove.

2. The pipe wrench of claim 1, wherein the elastic mechanism includes an engaging member and a second elastic member, the pivot has at least one receiving hole, and the engaging member and the second elastic member of the elastic mechanism are received within one of the at least receiving hole.

3. The pipe wrench of claim 2, wherein the second elastic member normally biases the engaging member toward an outside of the receiving hole, the engaging member is a ball, a hole diameter of the receiving hole is slightly greater than a diametric dimension of the ball, and a surface of the receiving hole is riveted so as to prevent the ball from falling off.

4. The pipe wrench of claim 1, wherein the pivot includes a first connecting member and a second connecting member, the first connecting member has a rod member, the rob member is disposed through the pivot hole of the second lever member, the second connecting member is abuttably connected to one of two ends of the rod member, and a first elastic member is sleeved to the rod member.

5. The pipe wrench of claim 4, wherein one of two ends of the first connecting member and one of two ends of the second connecting member which are remote from each other respectively have a first head portion and a second head portion projecting radially, and diametric dimensions of the first head portion and the second head portion are each greater than a width of the guide toothed groove.

6. The pipe wrench of claim 5, wherein one of two ends of the rod member which is remote from the first head portion further has a protrusive portion which has a smaller diameter, the protrusive portion is inserted into a through hole of the second connecting member, a fixing member is screwed with the protrusive portion from a side of the through hole which is remote from the first connecting member, a greatest diametric dimension of the fixing member is greater than a diametric dimension of the through hole, two radial sides of the rod member each have an engaging recess, a side of the second connecting member facing the first connecting member has a hole, the rod member is inserted into the hole, the hole communicates with the through hole, an internal circumferential wall of the hole has two engaging protrusions, and each of the two engaging protrusions is engaged with one of the two engaging recesses.

7. The pipe wrench of claim 4, wherein along the axial direction a width of a bottom edge of the first connecting member and an outer edge of the guide toothed groove which the first connecting member faces defines a third length, and the third length is greater than the second length.

8. The pipe wrench of claim 1, wherein a respective side of each of the at least one position-restricting toothed portion in the axial direction has a slant face section, and when the pivot moves to the released position, the slant face section of the position-restricting toothed portion faces the guide toothed groove to which the slant face section corresponds.

9. The pipe wrench of claim 1, wherein along the axial direction a shortest distance between the position-restricting toothed portion and the elastic mechanism to which the position-restricting toothed portion corresponds defines a first length, a thickness of the guide toothed groove along the axial direction defines a second length, and the second length is greater than the first length.

10. The pipe wrench of claim 1, wherein the first lever member has one said guide toothed groove, the second lever member has two partitions, the pivot hole is disposed through the two partitions, the first lever member is disposed between the two partitions, and the pivot is disposed through and pivoted to the pivot hole of the two partitions.

11. The pipe wrench of claim 1, wherein the body portion includes two side plates which correspond to each other and respectively have one of the at least one guide toothed groove, the two side plates have a receiving groove therebetween, one of two sides of each of the two side plates has a slide slot, the two slide slots and the two guide toothed grooves are parallel to each other and non-overlapping, the second lever member includes a driving grip and a clamping member, the driving grip and the first lever member are pivoted to the pivot, one of two ends of the driving grip has the second grip portion, the other of the two ends of the driving grip has a cam, the driving grip has the pivot hole, the pivot is disposed through the pivot hole, the clamping member includes the second clamping member and a slidable block which are connected to each other, the slidable block is slidable within the two slide slots, the clamping member has a recessed portion, the cam is abuttably inserted within the recessed portion, and through the driving grip sliding or swinging relative to the first lever member, the cam is capable of controlling the clamping member to slide relative to the first lever member.

12. The pipe wrench of claim 11, wherein the pivot further has a first elastic member, and the first elastic member biases between the driving grip and the pivot to make the pivot normally move toward the locked position.

13. The pipe wrench of claim 1, wherein each of the elastic mechanism and one of teeth of the position-restricting toothed portion have a common central line widthwise across the guide toothed groove.

14. The pipe wrench of claim 1, wherein the at least one elastic mechanism and the at least one position-restricting toothed portion are both partially overlapped with the at least one guide toothed groove during movement of the pivot from the locked position to the released position.

* * * * *